US009437993B2

(12) United States Patent
Stephens

(10) Patent No.: US 9,437,993 B2
(45) Date of Patent: Sep. 6, 2016

(54) DEVICE FOR IMPARTING ELECTRICAL ENERGY TO ONE OR MORE PLUGS

(71) Applicant: Thomas G. Stephens, Fort Worth, TX (US)

(72) Inventor: Thomas G. Stephens, Fort Worth, TX (US)

( * ) Notice: Subject to any disclaimer, the term of this patent is extended or adjusted under 35 U.S.C. 154(b) by 0 days.

(21) Appl. No.: 14/991,714

(22) Filed: Jan. 8, 2016

(65) Prior Publication Data

US 2016/0204561 A1 Jul. 14, 2016

Related U.S. Application Data

(60) Provisional application No. 62/176,895, filed on Jan. 8, 2015.

(51) Int. Cl.

| | |
|---|---|
| ***H01R 27/00*** | (2006.01) |
| ***H01R 27/02*** | (2006.01) |
| ***H01R 25/00*** | (2006.01) |
| ***H01R 24/30*** | (2011.01) |
| *H01R 107/00* | (2006.01) |

(52) U.S. Cl.

CPC ..... *H01R 27/02* (2013.01); *H01R 24/30* (2013.01); *H01R 25/006* (2013.01); *H01R 2107/00* (2013.01)

(58) Field of Classification Search

CPC ..... H01R 27/00; H01R 13/652
USPC ..... 439/222, 107, 956, 170, 488, 491
See application file for complete search history.

(56) References Cited

U.S. PATENT DOCUMENTS

2013/0278361 A1* 10/2013 Weeks ..... H05K 5/02 335/6
2013/0280956 A1* 10/2013 Cheng ..... H05K 5/02 439/620.15

* cited by examiner

*Primary Examiner* — Phuongchi T Nguyen
(74) *Attorney, Agent, or Firm* — Gagnon, Peacock & Vereeke P.C.; Aaron P. Peacock

(57) ABSTRACT

A device for imparting electrical energy to one or more male plugs, the device including at least three female receiving ports for receiving the blades from one or more male plugs wherein the at least three female receiving ports are positioned within the device side by side such that the first female receiving port is capable of receiving a hot blade from the male plug, the second female receiving port is capable of receiving a neutral blade from the male plug and the third female receiving port is capable of receiving a hot blade from the male plug.

5 Claims, 9 Drawing Sheets

DEVICE FOR IMPARTING ELECTRICAL ENERGY TO ONE OR MORE PLUGS

CROSS-REFERENCE TO RELATED APPLICATIONS

Applicant claims priority to U.S. Provisional Patent Application No. 62/176,895, filed Jan. 8, 2015, the disclosure of which is incorporated by reference herein in its entirety.

BACKGROUND OF THE INVENTION

Figure 1:
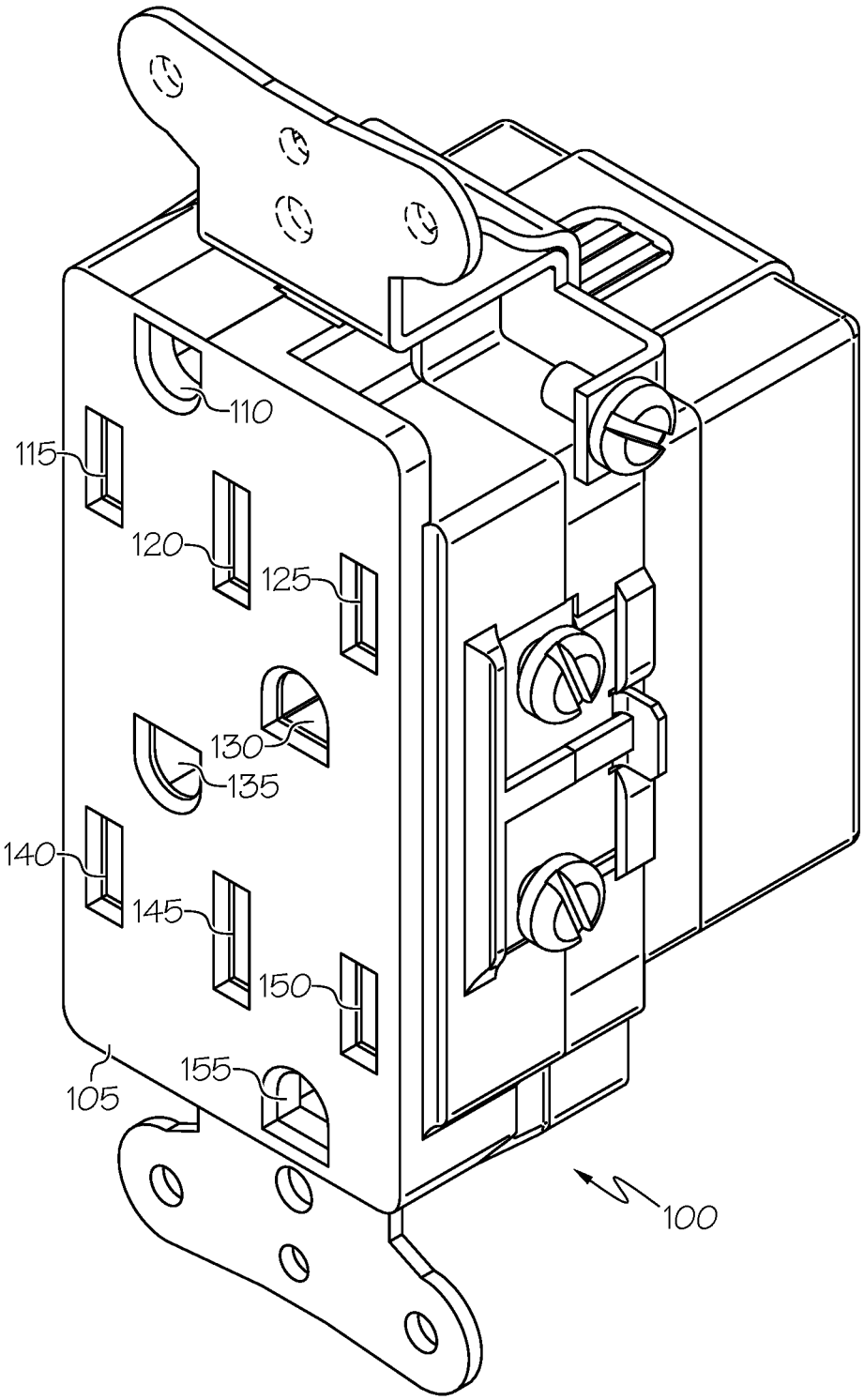
FIG. 1 is a perspective view of a device for imparting electrical energy to one or more plugs, comprising an embodiment of the present invention.

At the dawn of the modern era, the discovery of the intentional movement of electrons in a controlled environment to produce the phenomena of electricity was monumental. Once electricity could be caused at will and safely delivered to a particular location upon demand, it became almost indispensible to the stability and progress of mankind, especially in the developing countries around the world. Quickly, electricity's vast usefulness became apparent and helped launch much of the world into the modern industrial revolution. From aiding an individual in reading at night by providing power to a lamp to assisting a multinational corporation in operating a factory by providing power to heavy-duty machinery, electricity and its usefulness have not only transformed society but has propelled society far beyond imagination.

Governments, such as the United States, along with other strategic partners set out to build an infrastructure (i.e., national electrical grids) that would deliver electricity to nearly every home and business in both rural and urban areas. In the United States, electricity was soon available in nearly every community upon demand. The delivery of electricity to the masses necessitated a means for allowing each recipient to tap into and out of the electric power grid at will. As a result, the electric socket was born. The electric socket enables electrically operated equipment to be connected to the power supply.

Electrical plugs and sockets differ in voltage and current rating, shape, size and type of connectors. However, over the years, standards have emerged in different countries as to the rating, shape, size and type of electrical sockets/plugs. For example, there are currently fifteen (15) types of standard electrical outlet plugs in use today, each of which has been assigned a letter by the U.S. Department of Commerce International Trade Administration (ITA), starting with the letter "A" and moving through the alphabet. In the United States, type "A" and type "B" have been standardized and are used in homes and businesses across the country.

Type "A" is a class II ungrounded plug with two flat parallel prongs and is known as National Electrical Manufacturers Association (NEMA) 1-15. It has two flat 1.5 mm thick blades, measuring 15.9 to 18.3 mm in length and spaced 12.7 mm apart. It is generally polarized and can only be inserted in a socket one way because the two blades do not have the same width. The blade connected to the neutral is 7.9 mm wide and the hot blade is 6.3 mm wide. The socket for type "A" is constructed to accept the design of this type of plug.

Type "B" is a class I grounded plug and designated as American standard NEMA 5-15. It has two flat 1.5 mm thick blades, spaced 12.7 mm apart, measuring 15.9 to 18.3 mm in length and 6.3 mm in width. It also has a 4.8 mm diameter round or U-shaped earth pin, which is 3.2 mm longer than the two flat blades, for grounding purposes. The socket for type "B" is constructed to accept the design of this type of plug.

For decades, type "A" and "B" standardized plugs/sockets were sufficient in enabling electrical devices to access and tap into the electric power grid for power supply. However, with the advent of modern technology, such as the microprocessor and microchip, electronic devices have proliferated, particularly in recent years. Furthermore, electronic devices have become smaller, more mobile and more personalized. As a result, the amount of personal and portable electronic devices created, manufactured and used has grown exponentially. For example, in the last decade, the use of smartphones, tablets, notebook computers, netbooks and ebook readers, to name a few, have become commonplace among individuals nearly around the world. It is not unusual for an individual to use and personally carry one or more personal electronic devices with them throughout the day.

While these types of electronic devices have helped launched the world into a new digital era, they still must be powered and, in some cases, charged and recharged, typically via an electric socket/plug. As a result, electrical sockets are increasingly in high demand—much more so than just a decade ago. But, the electrical sockets of today, namely type "A" or "B," are no longer sufficient to meet today's needs. As the world is thrust more and more into the digital era and personal electronic devices continue to flourish in popularity, the electrical sockets of today are becoming less sufficient and, in some cases, even less safe.

For example, the heads of many household electric cord plugs are increasingly becoming larger and more complex. Additionally, smartphones and thin laptops introduced over the past decade heralded the inadvertent conversion of duplex outlets into single-use outlets. In the internet age of today, the sleek and cool factor in electric and electronic product designs has resulted in regular household and commercial outlets being inadvertently converted into single device plug in, due to the bulkiness of the cord plugs. Thus, a second device or even a regular electric cord plug is denied the sharing of that same outlet location. Therefore, the total number of devices that could be plugged into a household outlet (such as a type "A" or "B" outlet) has been effectively halved while, at the same time, the number of electronic devices used has multiplied. This has put even more of a demand on the value of outlets/electrical sockets as they become scarce due to overwhelming and constant use by more and more electrical devices.

Also, some electrical devices have long, thick cords extending from the head of the plug parallel to the wall of the outlet or the face cover of the outlet. The cord itself may block other devices from sharing the same outlet. This reduces the outlets usefulness and prevents its full use.

Additionally, there is also the prospect that two plugs are forced—or jammed—into sharing the same outlet. When this happens, an external stress is applied between the electric cord and the electric plug. As a result, a cord breaking or internal wire fraying can occur between the electric plug and the electric cord, thereby causing a short circuit, which may cause a fire. Further, the short circuit may even cause an electrical hazard for nearby individuals.

What is needed is a device capable of receiving one or more male plugs in a unique arrangement wherein such arrangement decreases the amount of space required for the plugs when connected to the device and reduces the risk of electrical hazards to individuals and property. More specifically, what is needed is a duplex socket, multiplex socket or receptacle capable of receiving one or more male plugs wherein the female receiving members of the socket/receptacle are uniquely arranged to reduce the amount of spaced required for the male plugs when the male plugs are received in the socket/receptacle, so that more plugs can be received in the socket/receptacle and/or received in a different orientation all the while decreasing the electrical hazards to person or property.

The aforementioned device capable of receiving one or more male plugs wherein the receiving female members of the device are arranged to efficiently reduce the amount of space required on the device for the receiving of the one or more male plugs and/or permit the one or more male plugs to be received in a different and more efficient orientation is a novel and nonobvious invention that meets the needs described above. Disclosed herein are embodiments of the present invention. However, it should be noted that the present invention can comprise additional embodiments not necessarily disclosed in this paper.

One embodiment of the present invention is a device for imparting electrical energy such as electricity, which comprises at least three female receiving ports for receiving the blades from one or more male plugs wherein the at least three female receiving ports are positioned within the device side by side such that the first female receiving port is a port for receiving a hot blade, the second female receiving port is a port for receiving a neutral blade and the third female receiving port is a port for receiving a hot blade. The unique arrangement and position of the at least three female receiving ports permits a plug to be received rotated/reoriented. For example, the device can receive a plug in one orientation, or, if necessary, the plug can be rotated and reoriented 180 degrees and received. This occurs when the plug is rotated 180 degrees and instead of being received by the first and second three female receiving ports of the device, it is received by the second and third female receiving ports. Thus, a plug can be received one way or rotated 180 degrees and received another way.

Another embodiment of the present invention includes the at least three female receiving ports positioned within the device as described above as well as at least two grounding female receiving ports positioned within the device wherein the first of the at least two grounding female receiving ports is positioned between and above the first female receiving port and the second female receiving ports such that the first of the at least two grounding female receiving ports permits the reception of a right-side up U-shaped pin and wherein the second of the at least two grounding female receiving ports is positioned between and below the second female receiving port and the third female receiving port such that the second of the at least two grounding female receiving ports permits the reception of an upside down U-shaped pin.

Yet, another embodiment of the present invention includes the at least three female receiving ports positioned within the device as described above as well as at least two grounding female receiving ports positioned within the device wherein the first of the at least two grounding female receiving ports is positioned between and below the first female receiving port and the second female receiving ports such that the first of the at least two grounding female receiving ports permits the reception of a upside down U-shaped pin and wherein the second of the at least two grounding female receiving ports is positioned between and above the second female receiving port and the third female receiving port such that the second of the at least two grounding female receiving ports permits the reception of an right-side up U-shaped pin.

Further, another embodiment of the present invention includes the at least three female receiving ports positioned within the device as described above as well as at least one universal serial bus (USB) port positioned within the device for connecting electronic devices having a USB connectivity port to the USB port of the device.

DETAILED DESCRIPTION OF THE INVENTION

In this paper, it should be understood that when the word "plug" is used, it is meant to include either a type "A" plug or a type "B" plug. Furthermore, the plug, including any device for receiving the plug per the present invention such as an electrical socket, comprises the dimension(s) as defined by the national standards for receiving a type "A" plug or a type "B" plug. For example, type "A" includes a neutral blade and a hot blade (no earth U-shaped pin), the neutral blade having a width of 7.9 mm, the hot blade having a width of 6.3 mm and the neutral blade and hot blade spaced apart by 12.7 mm apart. The standard dimensions for type "A" and "B" plugs should be applied to the present invention. Additionally, it should be understood that when referring to the present invention, the word "device" mean, without limitation, a socket, electrical socket, duplex socket, multiplex socket, receptacle, outlet, electrical outlet, power strip, adaptor or any other device which permits one or more plugs to be connect/received thereto for the reception of electrical energy.

Turning to FIG. 1, which depicts an embodiment of the present invention, an electrical socket 100 and the faceplate 105 attached thereto are shown. The electrical socket 100 comprises at least three female receiving ports 115 120 125 for receiving the blades from one or more male plugs wherein the at least three female receiving ports 115 120 125 are positioned within the electric socket 100 side by side but spatially set apart per the guidelines of the standards for type "A" and "B" plugs such that the first female receiving port 115 is a port for receiving a hot blade, the second female receiving port 120 is a port for receiving a neutral blade and the third female receiving port 125 is a port for receiving a hot blade.

Moreover, because the electric socket 100 receives either type "A" or "B" plugs, the electrical socket 100 comprises ports for receiving the earth pin for grounding purposes. As such, the electrical socket 100 also comprises at least two grounding female receiving ports 110 130 positioned within the electrical socket 100 wherein the first of the at least two grounding female receiving ports 110 is positioned between and above the first female receiving port 115 and the second female receiving ports 120 such that the first of the at least two grounding female receiving ports 110 permits the reception of a right-side up U-shaped pin and wherein the second of the at least two grounding female receiving ports 130 is positioned between and below the second female receiving port 120 and the third female receiving port 125 such that the second of the at least two grounding female receiving ports 130 permits the reception of an upside down U-shaped pin.

This embodiment may also include reiterations of the ports positioned within the device as shown in FIG. 1. The electrical socket 100 may also comprise at least three female receiving ports 140 145 150 for receiving the blades from one or more male plugs wherein the at least three female receiving ports 140 145 150 are positioned within the electric socket 100 side by side but spatially set apart per the guidelines of the standards for type "A" and "B" plugs such that the first female receiving port 140 is a port for receiving a hot blade, the second female receiving port 145 is a port for receiving a neutral blade and the third female receiving port 150 is a port for receiving a hot blade.

The electrical socket 100 can also comprise at least two grounding female receiving ports 135 155 positioned within the electrical socket 100 wherein the first of the at least two grounding female receiving ports 135 is positioned between and above the first female receiving port 140 and the second female receiving ports 145 such that the first of the at least two grounding female receiving ports 135 permits the reception of a right-side up U-shaped pin and wherein the second of the at least two grounding female receiving ports 155 is positioned between and below the second female receiving port 145 and the third female receiving port 150 such that the second of the at least two grounding female receiving ports 155 permits the reception of an upside down U-shaped pin.

Figure 2:
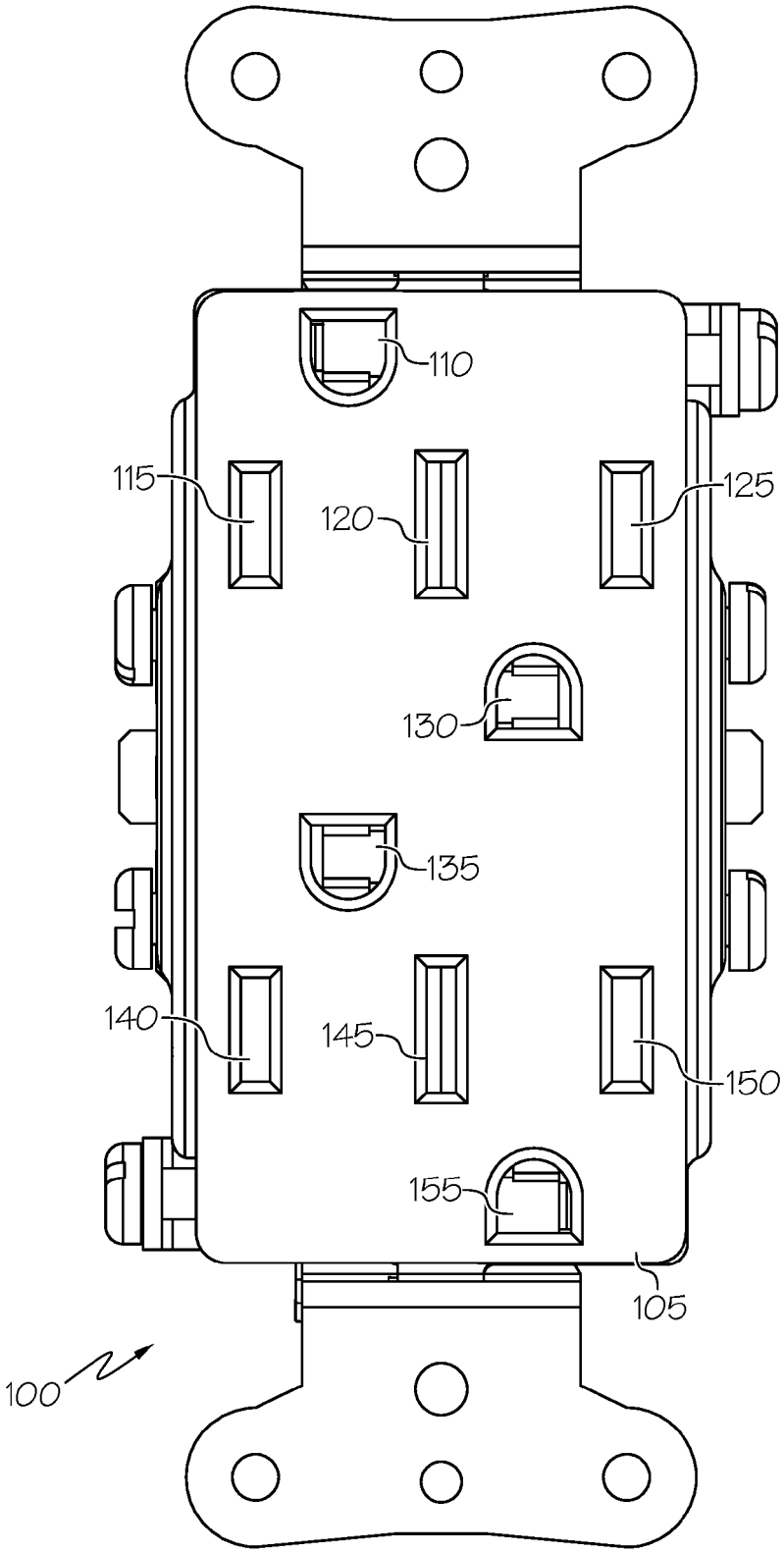
FIG. 2 is a front view of the device of FIG. 1.

FIG. 2 depicts a front view the electric socket 100 of FIG. 1.

Figure 3:
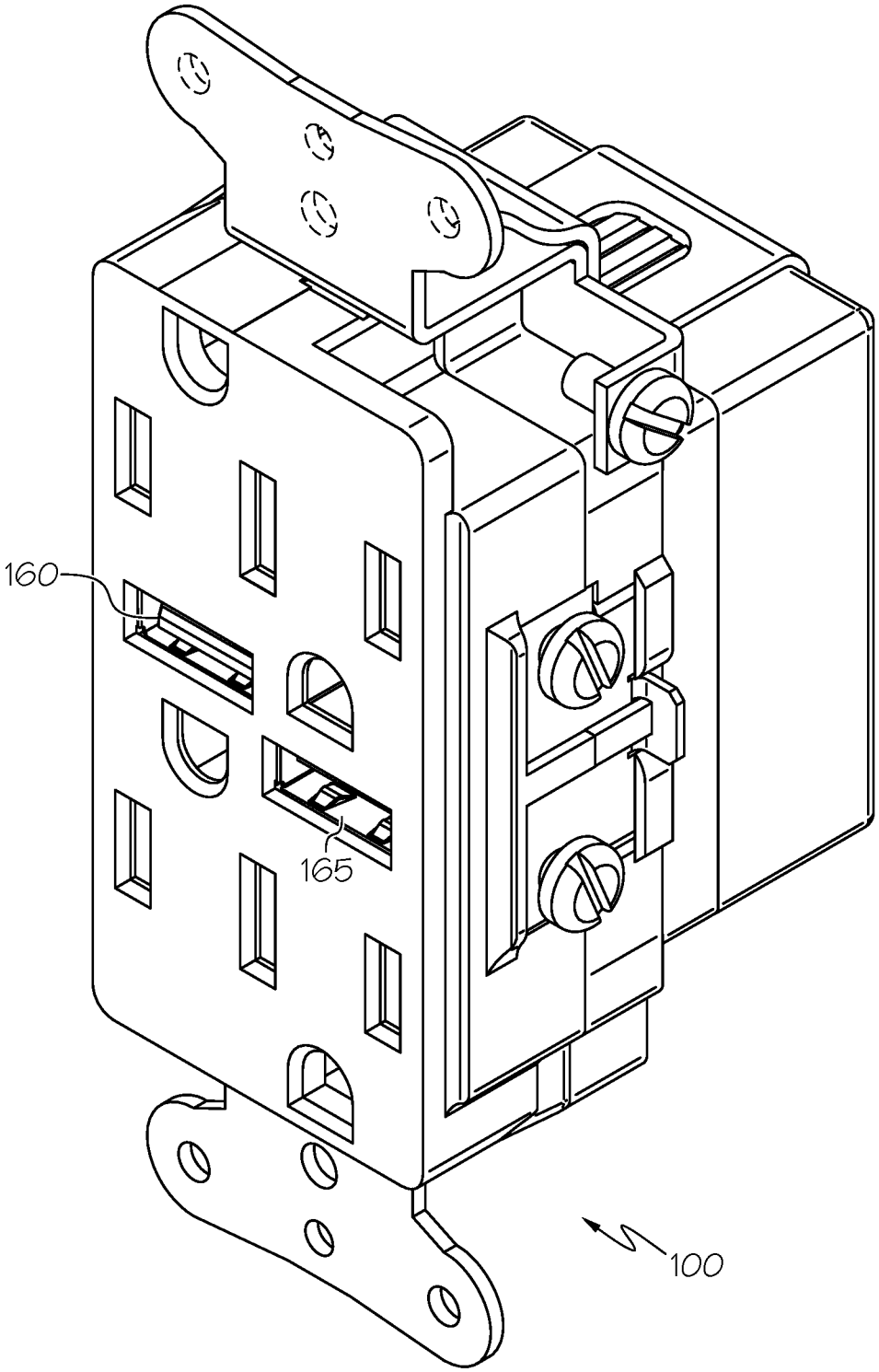
FIG. 3 is a perspective view of a device for imparting electrical energy to one or more plugs, comprising another embodiment of the present invention.
Figure 4:
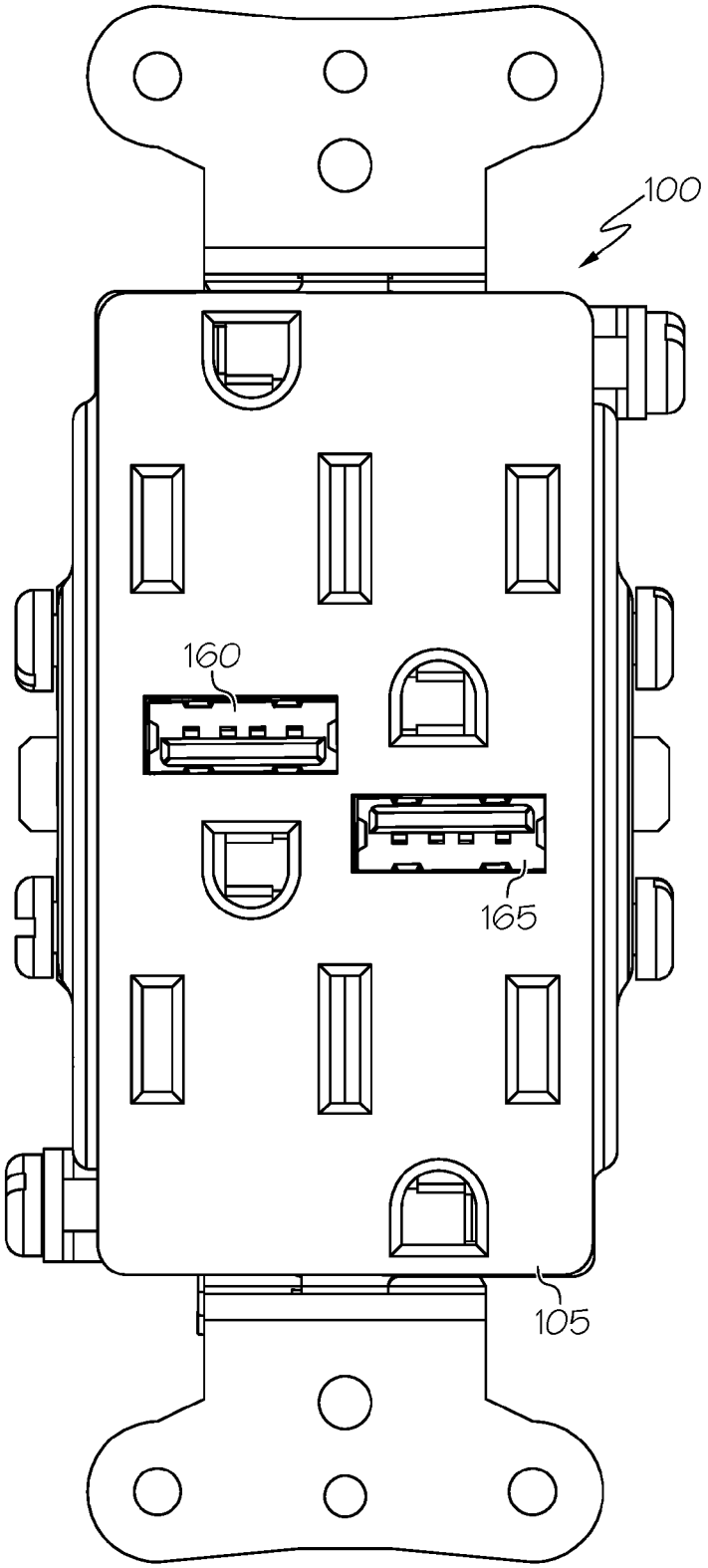
FIG. 4 is a front view of the device of FIG. 3.

FIG. 3 illustrates another embodiment of the present invention. FIG. 3 depicts the embodiment of the present invention shown in FIG. 1 but with the inclusion of USB ports. FIG. 3 illustrates the electric socket 100 having a first USB port 160 and a second USB port 165. It should be noted that this embodiment can comprise one or more USB ports. FIG. 4 depicts a front view of the electric socket 100 of FIG. 3.

Figure 5:
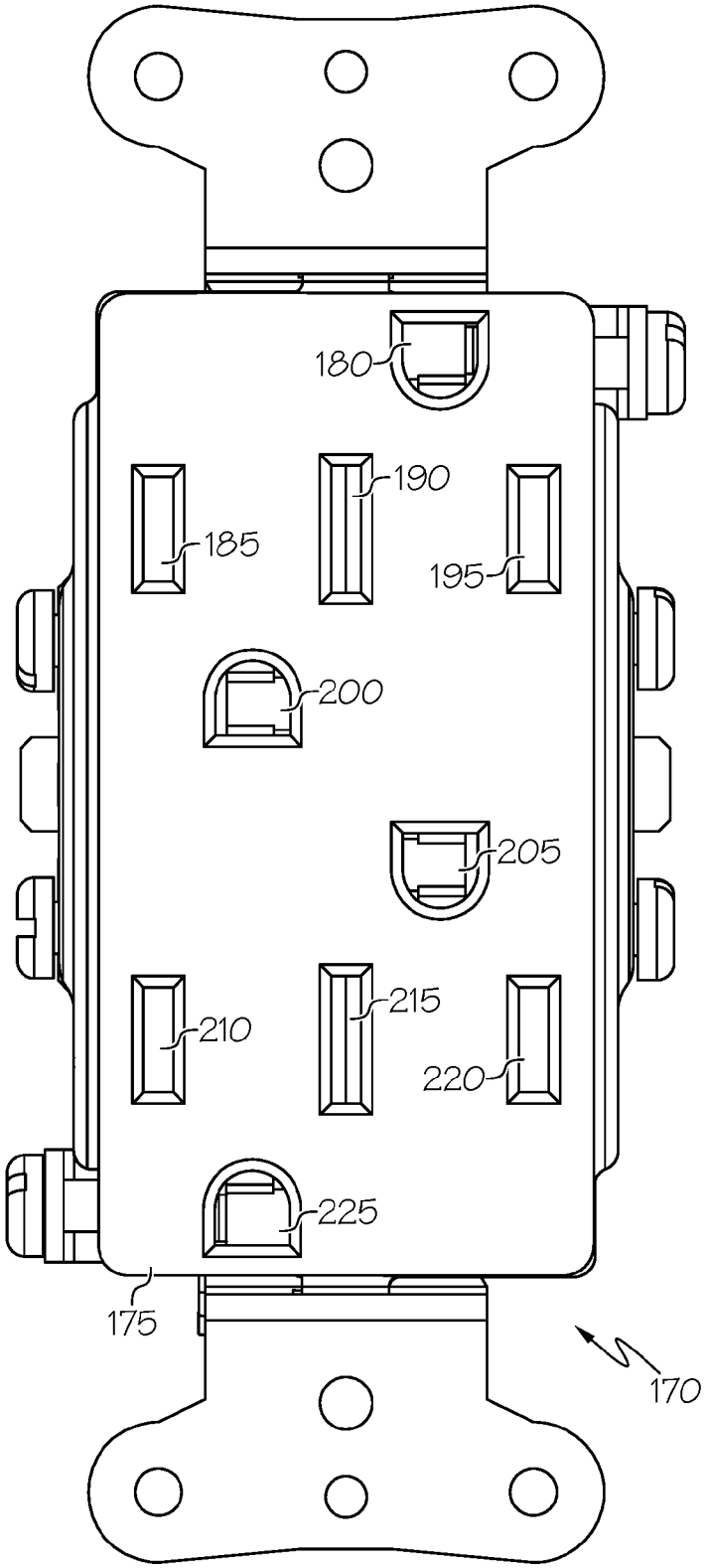
FIG. 5 is a front view of a device for imparting electrical energy to one or more plugs, comprising yet another embodiment of the present invention.

Turning to FIG. 5, an electric socket 170 and a faceplate 175 attached thereto are shown, depicting yet another embodiment of the present invention. Electric socket 170 comprises at least three female receiving ports 185 190 195 for receiving the blades from one or more male plugs wherein the at least three female receiving ports 185 190 195 are positioned within the electric socket 170 side by side but spatially set apart per the guidelines of the standards for type "A" and "B" plugs such that the first female receiving port 185 is a port for receiving a hot blade, the second female receiving port 190 is a port for receiving a neutral blade and the third female receiving port 195 is a port for receiving a hot blade.

Moreover, because the electric socket 170 receives either type "A" or "B" plugs, the electrical socket 170 comprises ports for receiving the earth pin for grounding purposes. As such, the electrical socket 170 also comprises at least two grounding female receiving ports 200 180 positioned within the electrical socket 170 wherein the first of the at least two grounding female receiving ports 200 is positioned between and below the first female receiving port 185 and the second female receiving ports 190 such that the first of the at least two grounding female receiving ports 200 permits the reception of a upside down U-shaped pin and wherein the second of the at least two grounding female receiving ports 180 is positioned between and above the second female receiving port 190 and the third female receiving port 195 such that the second of the at least two grounding female receiving ports 180 permits the reception of an right-side up U-shaped pin.

This embodiment may also include reiterations of the ports positioned within the device as shown in FIG. 5. For example, the electrical socket 170 can also comprise at least three female receiving ports 210 215 220 for receiving the blades from one or more male plugs wherein the at least three female receiving ports 210 215 220 are positioned within the electric socket 170 side by side but spatially set apart per the guidelines of the standards for type "A" and "B" plugs such that the first female receiving port 210 is a port for receiving a hot blade, the second female receiving port 215 is a port for receiving a neutral blade and the third female receiving port 220 is a port for receiving a hot blade.

The electrical socket 170 can also comprises at least two grounding female receiving ports 225 205 positioned within the electrical socket 170 wherein the first of the at least two grounding female receiving ports 225 is positioned between and below the first female receiving port 210 and the second female receiving ports 215 such that the first of the at least two grounding female receiving ports 225 permits the reception of a upside down U-shaped pin and wherein the second of the at least two grounding female receiving ports 205 is positioned between and above the second female receiving port 215 and the third female receiving port 220 such that the second of the at least two grounding female receiving ports 205 permits the reception of an right side up U-shaped pin.

Figure 6:
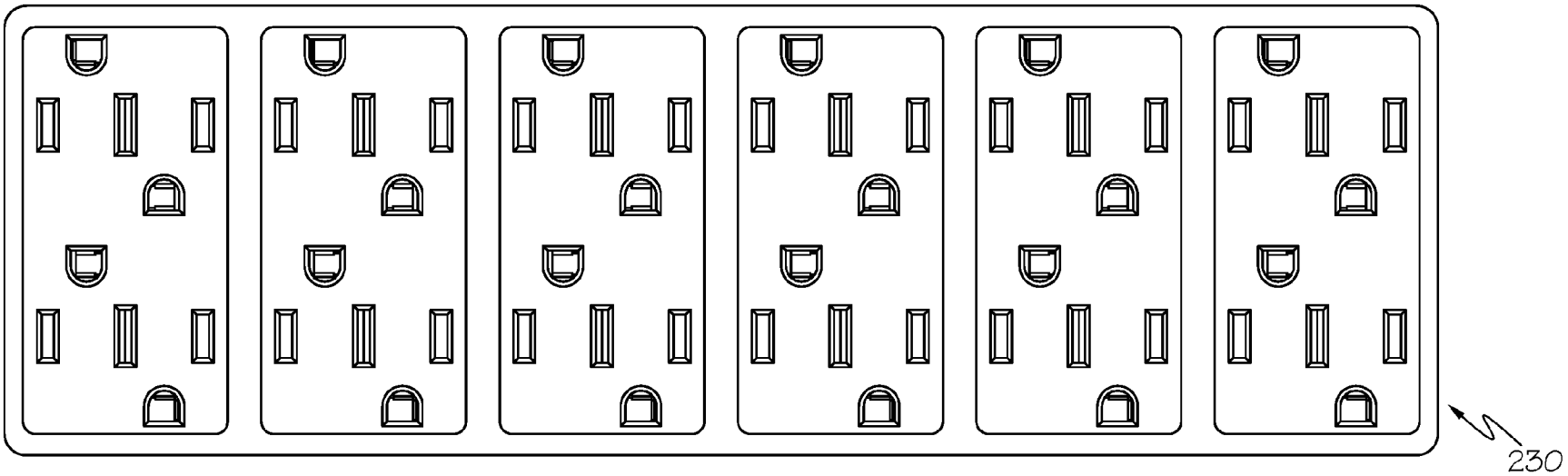
FIG. 6 is a top view of a power strip, which includes an embodiment of the present invention.
Figure 7:
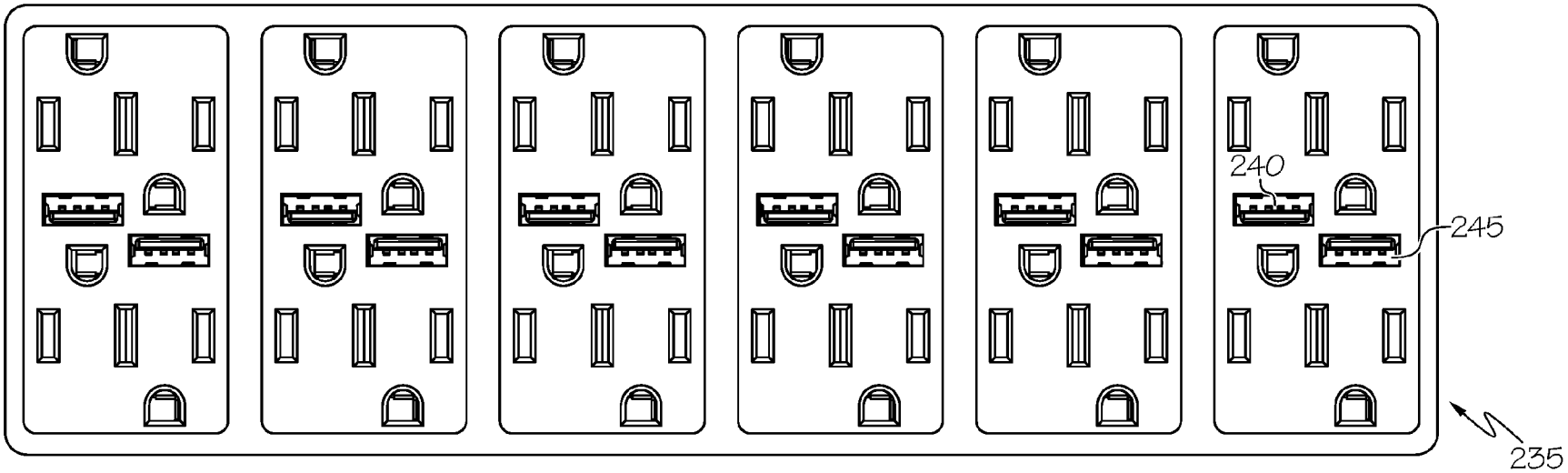
FIG. 7 is a top view of a power strip, which includes yet another embodiment of the present invention.

FIG. 6 illustrations an embodiment of the present invention shown as a power supply unit/power strip 230. FIG. 7 illustrations another embodiment of the present invention, while also a power supply unit/power strip 235, having a plurality of USB ports as shown by a first USB port 240 and a second USB port 245.

Figure 8:
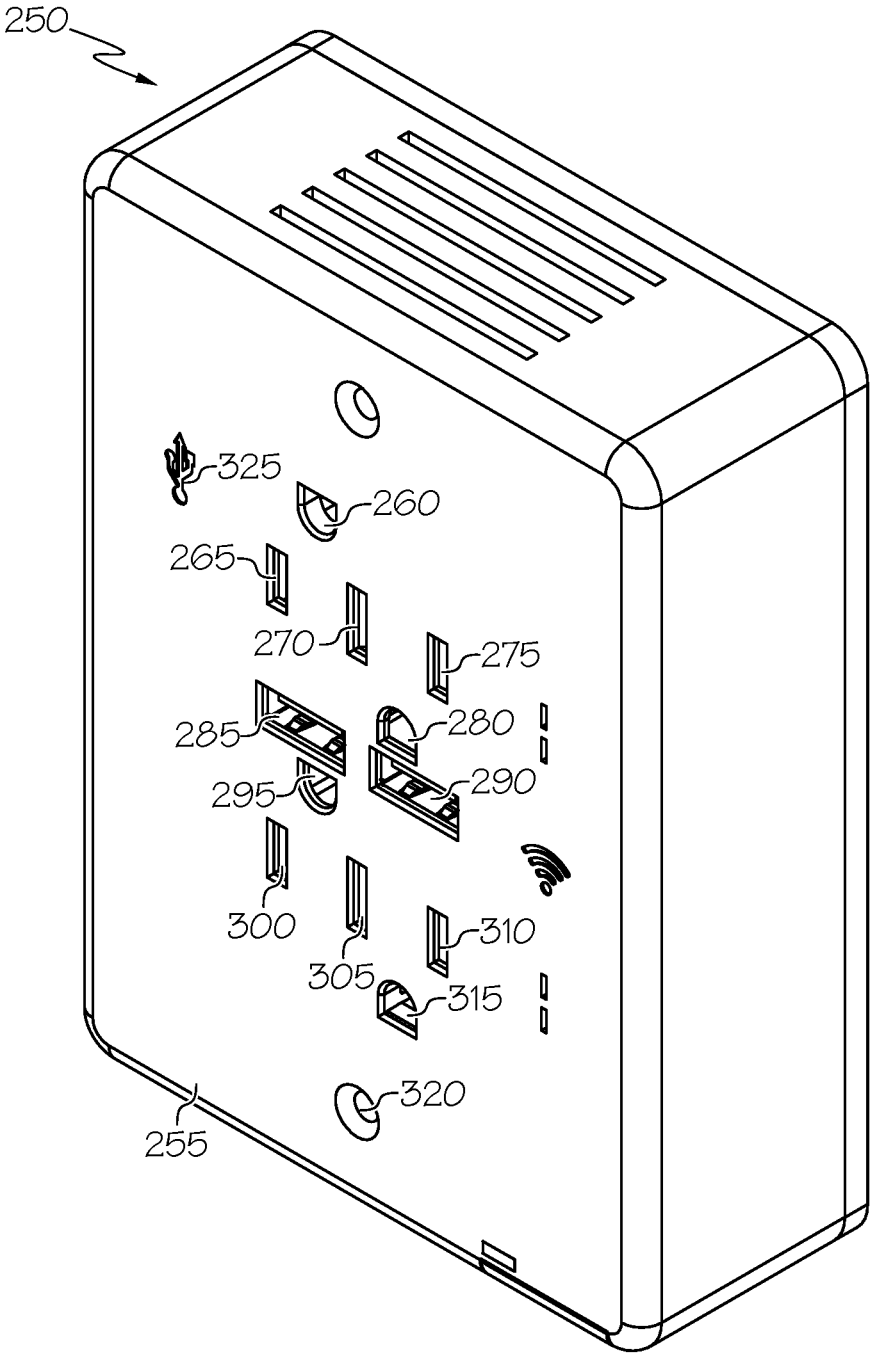
FIG. 8 is a perspective view of an adapter, which includes an embodiment of the present invention.

FIG. 8 depicts an embodiment of the present invention as an adaptor 250. The adaptor 250 can plug into an electric socket, thereby causing the electric socket in which it is plugged to increase in the amount of plugs to which it can provided electrical energy. The plug for the adaptor 250 can be located at the back of the adaptor 250, which would plug into any electrical outlet/socket. The adaptor has a faceplate 255. Similar to what is shown in FIG. 1, the adaptor 250 comprises at least three female receiving ports 265 270 275 for receiving the blades from one or more male plugs wherein the at least three female receiving ports 265 270 275 are positioned within the electric socket 250 side by side but spatially set apart per the guidelines of the standards for type "A" and "B" plugs such that the first female receiving port 265 is a port for receiving a hot blade, the second female receiving port 270 is a port for receiving a neutral blade and the third female receiving port 275 is a port for receiving a hot blade.

Moreover, because the adaptor 250 receives either type "A" or "B" plugs, the adaptor 250 comprises ports for receiving the earth pin for grounding purposes. As such, the adaptor 250 also comprises at least two grounding female receiving ports 260 280 positioned within the adaptor 250 wherein the first of the at least two grounding female receiving ports 260 is positioned between and above the first female receiving port 265 and the second female receiving ports 270 such that the first of the at least two grounding female receiving ports 260 permits the reception of a right-side up U-shaped pin and wherein the second of the at least two grounding female receiving ports 280 is positioned between and below the second female receiving port 270 and the third female receiving port 275 such that the second of the at least two grounding female receiving ports 280 permits the reception of an upside down U-shaped pin.

This embodiment may also include reiterations of the ports. For example, the adaptor 250 can also comprises at least three female receiving ports 300 305 310 for receiving the blades from one or more male plugs wherein the at least three female receiving ports 300 305 310 are positioned within the electric socket 250 side by side but spatially set apart per the guidelines of the standards for type "A" and "B" plugs such that the first female receiving port 300 is a port for receiving a hot blade, the second female receiving port 305 is a port for receiving a neutral blade and the third female receiving port 310 is a port for receiving a hot blade.

The adaptor 250 can also comprises at least two grounding female receiving ports 295 315 positioned within the adaptor 250 wherein the first of the at least two grounding female receiving ports 295 is positioned between and above the first female receiving port 300 and the second female receiving ports 305 such that the first of the at least two grounding female receiving ports 295 permits the reception of a right-side up U-shaped pin and wherein the second of the at least two grounding female receiving ports 315 is positioned between and below the second female receiving port 305 and the third female receiving port 310 such that the second of the at least two grounding female receiving ports 315 permits the reception of an upside down U-shaped pin.

Figure 9:
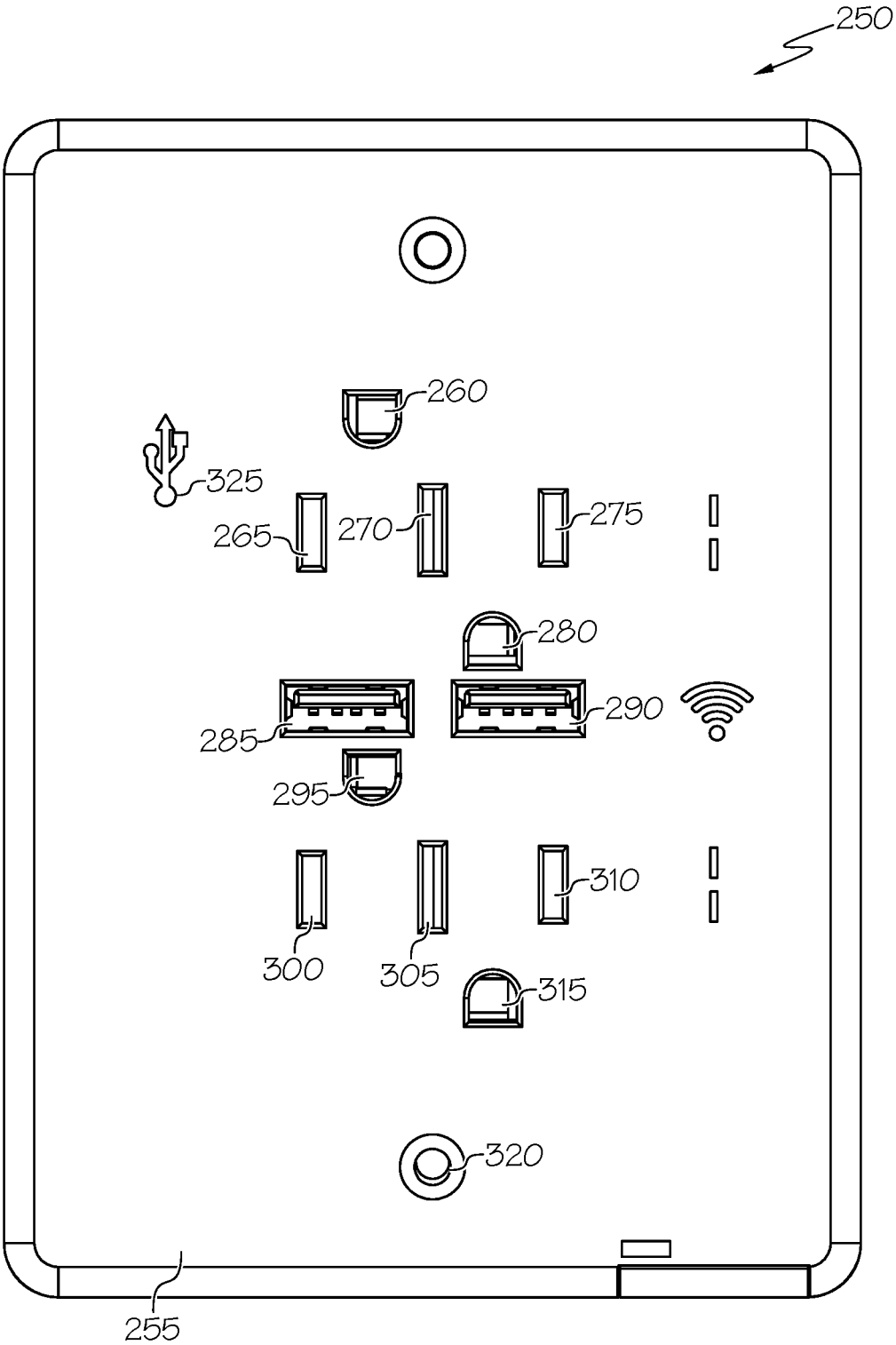
FIG. 9 is a front view of the adapter of FIG. 8.

Additional, the embodiment of FIG. 8 can comprise visual alert signals 320 325 to alert a user concerning the use of the adaptor 250. FIG. 9 depicts a front view of FIG. 8.

Although many embodiments of the present invention have been illustrated in the accompanying Drawings and described in the foregoing Detailed Description, it should be understood that the present invention is not limited to the embodiments disclosed, but is capable of numerous rearrangements, modifications, and substitutions of parts and elements without departing from the spirit of the invention.

What is claimed is:

1. A device for imparting electrical energy to one or more male plugs, the device comprising at least three female receiving ports for receiving the blades from one or more male plugs wherein the at least three female receiving ports are positioned within the device side by side such that the first female receiving port is capable of receiving a hot blade from the male plug, the second female receiving port is capable of receiving a neutral blade from the male plug and the third female receiving port is capable of receiving a hot blade from the male plug;

at least two grounding female receiving ports positioned within the device wherein the first of the at least two grounding female receiving ports is positioned between and above the first female receiving port and the second female receiving port and is capable of receiving a right-side up U-shaped pin from the male plug and wherein the second of the at least two grounding female receiving ports is positioned between and below the second female receiving port and the third female receiving port and is capable of receiving an upside down U-shaped pin from the male plug.

2. The device of claim 1 further comprising at least one universal serial bus port.

3. A device for imparting electrical energy to one or more male plugs, the device comprising at least three female receiving ports for receiving the blades from one or more male plugs wherein the at least three female receiving ports are positioned within the device side by side such that the first female receiving port is capable of receiving a hot blade from the male plug, the second female receiving port is capable of receiving a neutral blade from the male plug and the third female receiving port is capable of receiving a hot blade from the male plug;

at least two grounding female receiving ports positioned within the device wherein the first of the at least two grounding female receiving ports is positioned between and below the first female receiving port and the second female receiving port and is capable of receiving an upside down U-shaped pin from the male plug and wherein the second of the at least two grounding female receiving ports is positioned between and above the second female receiving port and the third female receiving port is capable of receiving a right-side up U-shaped pin from the male plug.

4. The device of claim 3 further comprising at least one universal serial bus port.

5. The device of claim 4 further comprising one or more visual alert signals positioned thereon.

* * * * *